US007866111B2

(12) United States Patent
Johansson

(10) Patent No.: US 7,866,111 B2
(45) Date of Patent: Jan. 11, 2011

(54) PROFILED RAIL AND FLOORBOARD FOR FLOORING SYSTEM

(75) Inventor: Roy Johansson, Nybro (SE)

(73) Assignee: AB Gustaf Kahr (SE)

( * ) Notice: Subject to any disclaimer, the term of this patent is extended or adjusted under 35 U.S.C. 154(b) by 256 days.

(21) Appl. No.: 12/075,473

(22) Filed: Mar. 11, 2008

(65) Prior Publication Data

US 2008/0302044 A1 Dec. 11, 2008

(30) Foreign Application Priority Data

Mar. 14, 2007 (SE) ..... 0700629

(51) Int. Cl.
*E04F 13/08* (2006.01)

(52) U.S. Cl. ..... 52/588.1; 52/582.1; 52/582.2; 52/391

(58) Field of Classification Search ..... 52/588.1, 52/582.1, 582.2, 391, 592.1, 589.1, 571, 52/586.1, 591.1, 578, 572, 590.2; 403/329
See application file for complete search history.

(56) References Cited

U.S. PATENT DOCUMENTS 4,385,850 A * 5/1983 Bobath ..... 403/205
4,599,842 A * 7/1986 Counihan ..... 52/586.2
5,622,012 A * 4/1997 Schijf ..... 52/71
6,363,677 B1 4/2002 Chen et al.
6,460,306 B1 * 10/2002 Nelson ..... 52/582.1
6,763,643 B1 7/2004 Mårtensson
6,769,217 B2 8/2004 Nelson
7,021,019 B2 * 4/2006 Knauseder ..... 52/588.1
2007/0028547 A1 2/2007 Grafenauer et al.

FOREIGN PATENT DOCUMENTS

DE 19909983 2/2000
WO WO-00/20706 A1 4/2000
WO WO-2004/053256 A1 6/2004
WO WO-2006/005315 A1 1/2006
WO WO-2006/136412 A1 12/2006

* cited by examiner

*Primary Examiner*—Richard E Chilcot, Jr.
*Assistant Examiner*—Chi Nguyen
(74) *Attorney, Agent, or Firm*—Schwegman, Lundberg & Woessner, P.A.

(57) ABSTRACT

Floor laying system for joining together floorboards, including grooves made in opposing side edges of the boards, and a separate profiled rail, which is disposed between the side edges of the boards and couples together the boards and which has legs projecting to opposite sides from a central section of the rail, which legs are designed to lockingly engage in the grooves in the respective opposing side edges of the floorboards. The legs of the profiled rail delimit a channel-shaped cavity which can accommodate at least one line element. The profiled rail has legs, which supportively bear against diagonally opposing beveled faces of the grooves in two adjacent boards, in addition to which a slot running substantially parallel with the top and bottom sides of the respective board opens into the groove to form a resilient tongue.

14 Claims, 3 Drawing Sheets

PROFILED RAIL AND FLOORBOARD FOR FLOORING SYSTEM

BACKGROUND

It is known to design the longitudinal side edges of floorboards with all sorts of mutually engaging configurations to enable the floorboards to be laid tight together in interlocking arrangement without the boards needing to be glued or nailed. One side edge configuration normally has a tongue or tenon, which is designed to lockingly engage in a groove or notch in the opposing side edge of an adjacent floorboard. The short-side or end-side edges can also be provided with mutually engaging tongues and grooves. These glue-free and nail-free laying systems of the "snap-in type" generally work very well for the creation of so-called floating laminated parquet floors.

In the laying of floor heating systems in combination with such floors, loops of electric floor heating cables or hot water pipes are usually first laid in or on the sub-floor, before the floorboards are laid on top of these with, inter alia, an intermediate, tread-damping layer. This implies a large-scale laying exercise and an increased structural height of the floor.

Floorboards having integrated grooves for laying of electric cables for floor heating have also been proposed; see, for example, GB 888,842 and WO 2006/039726. In these solutions, the electric cable can be laid in a groove within the thickness of the boards at the actual joint between adjacent floorboards, so that the structural height has no need to be increased. However, the laying of the heating cable in a milled-out groove implies a less good distribution and spreading of the heat in the floor, the heat emission instead being concentrated onto the actual groove region, with increased risk of drying-out and cracking.

Another peculiarity which characterizes existing floorboards, regardless of whether or not they have integrated grooves for the laying of heating cables, is that the opposite longitudinal side edges of each board must be designed with different, complementary engagement profiles, which means that a board can only be laid with its one side against a previously laid board.

WO 2006/136412 A1 and EP 1 585 875 B1 describe floor laying systems in which a profiled rail which couples together the boards is designed with a hollow, asymmetrical profile corresponding to the asymmetrical profile of the board, so that the profiled rail forms a board-like bridge element between the boards, in which electric cables, for example, can be laid. The side grooves in the respective neighbouring boards have no crosswise diagonally opposing beveled faces, nor do they have a slot opening into each groove, which slot runs substantially parallel with the top and bottom sides of the board and forms with the bottom side in each opposing board a resilient tongue that presses the profiled rail with a substantially constant pressure against a diagonally opposing beveled face in the opposing board. This can give rise to a risk of gaps being formed, which are caused, above all, by changes in humidity and temperature. In order to avoid this risk of gaps, a resilient interaction between the integral components is required, which offers the chance of humidity and temperature related expansion and shrinkage movements of the boards, with maintained cohesion between the same. The profiled rails in the just named WO and EP publications are also without flanges which are essential to the coupling and diverge towards the top side of the boards and which engage in corresponding recesses in each groove.

SUMMARY

One embodiment of the present invention is to propose a floor laying system for joining together floorboards along side edges thereof, which system utilizes a separate, coupling profiled element which, apart from the fact that it produces a channeling between them, in which any chosen line elements can be laid, such as an electric cable for floor heating, a pipe for waterborne heating of the floor, aerial or signal cables, alarm detectors, hearing loops, and the like, also creates a locking joining-together of adjacent boards without potential risk of gap formation between the boards.

For an embodiment, the floor laying system is characterized in that each leg of the profiled rail has a first section having a thereto connecting, projecting flange for engagement in a corresponding recess which opens into the groove in the side edge of the respective floorboard, in which the flanges of the profiled rail and the corresponding recesses in the grooves diverge towards that side of the floorboards which forms a top surface layer thereof, and in that the legs of the profiled rail have a respective second section, which converges towards that side of the floorboards which forms a bottom side thereof, wherein the first section of each leg bears against a first beveled face of the groove, whilst the second section of each leg bears against a second beveled face of the groove in the side edge of the respective floorboard, and wherein the first beveled face of the one of two coupled-together floorboards is substantially diametrically opposite the second beveled face of the other of the coupled-together floorboards, in addition to which a slot running substantially parallel with the top and bottom sides of the respective board opens into the groove in each floorboard between the said recesses and the second beveled face.

Advantageous embodiments of the floor laying system according to various aspects of the invention are defined herein. In one expedient embodiment, the grooves in the opposing side edges of two coupled-together floorboards can be designed such that the profiled rail lies mounted therein fully concealed from the top side of the floorboards. In addition, it is advantageous if the profiled rail and the grooved configuration of the side edges of the floor boards are designed in mirror symmetry relative to a longitudinal center plane through a joint between adjacent floorboards. It is hence possible to lay the floorboards with any chosen side one against the other.

The invention also comprises a profiled rail for, in floor laying, lockingly joining together floorboards along side edges thereof to form a floor laying system according to the above.

The distinguishing features which are characteristic of the actual floorboard according to the invention are defined in various expedient embodiments of the floorboard.

Various applications of the floor laying system according to the invention are defined herein.

Further characterizing features and advantages of the various embodiments of the present invention will emerge in greater detail below and with reference to the attached drawings.

DETAILED DESCRIPTION OF PREFERRED EMBODIMENTS

Figure 1:
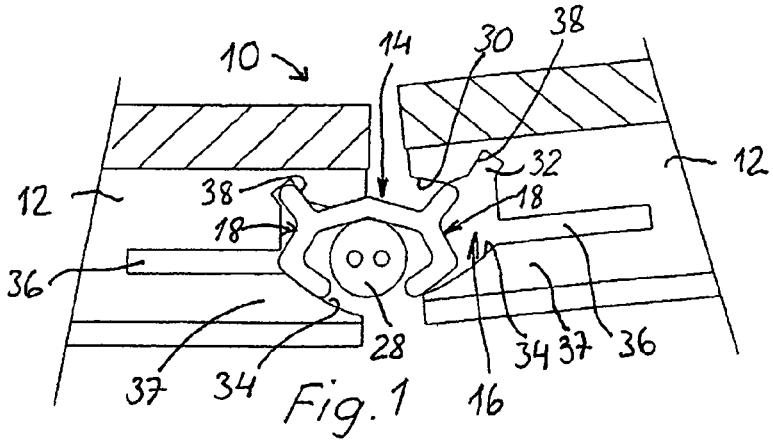
FIG. 1 shows schematically in cross-sectional view a joining-together phase of a floor laying system according to the invention, using a profiled rail which couples together two floorboards and has an open cavity containing an electric cable, laid therein, for floor heating.
Figure 2:
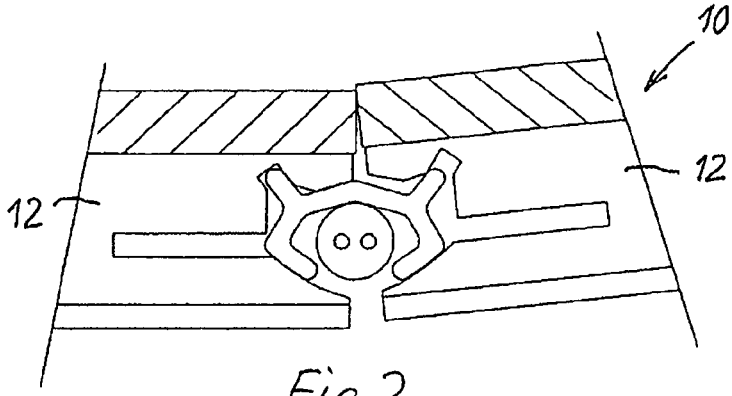
FIG. 2 is a schematic cross-sectional view of the floor laying system in FIG. 1 during a subsequent joining-together phase.
Figure 3:
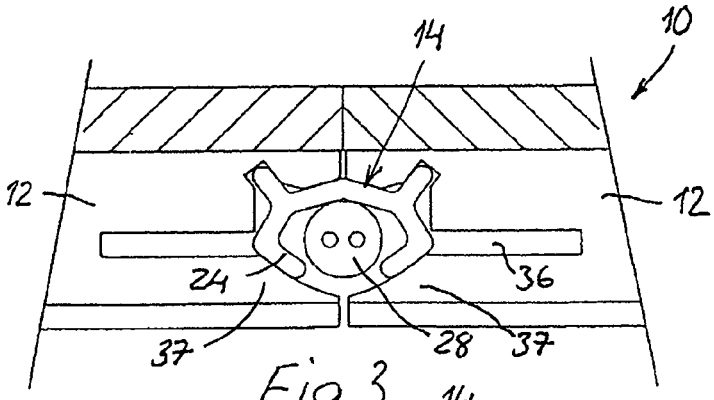
FIG. 3 is a schematic cross-sectional view of the floor laying system in a finished, joined-together state.
Figure 4:
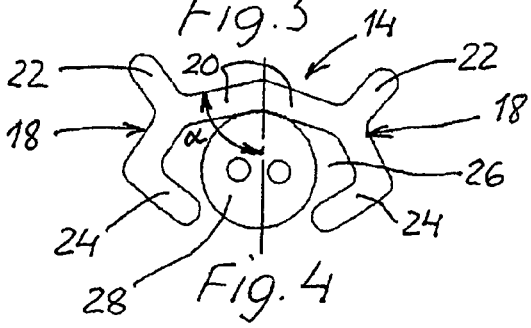
FIG. 4 is a cross section of a first embodiment of the profiled rail according to the invention, which is used in FIGS. 1-3.
Figure 8:
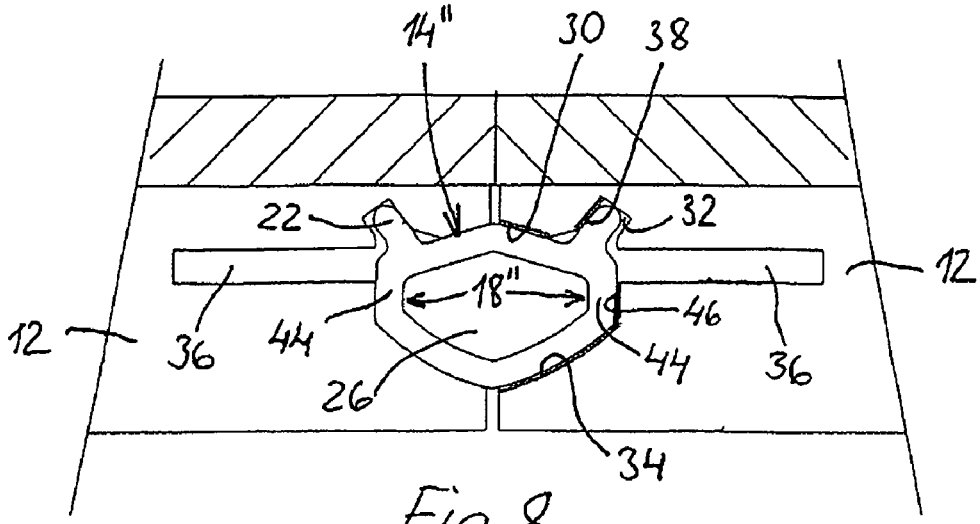
FIG. 8 is a view similar to FIG. 3 of an embodiment with closed profiled rail.

In FIGS. 1-3, a first embodiment is shown of a floor laying system 10 according to the present invention for lockingly joining together adjacent floorboards 12 when a floating laminated parquet floor 12, for example, is laid on top of an existing sub-floor. The basic structure of the system 10 is such that the floorboards 12 are joined together with the aid of a special, separate profiled rail 14, the profile of which is designed to lockingly engage in complementary grooves 16 in the side edges of the floorboards 12. As is most clearly shown in FIG. 4, the profile rail 14, viewed in cross section, has two legs 18, projecting from a central section and having an, in the assembled position, upper part 20, from which a flange 22 projects which is directed obliquely upwards. Adjoining the upper part 20 is a lower leg part 24, which is directed obliquely inwards and downwards towards the longitudinal center plane of the profiled rail. The legs 18 of the profiled rail 14 are configured such that, viewed in the peripheral direction of the rail, they form an open profile, which delimits an inner cavity 26 in which line elements, such as an electric cable 28 for floor heating, or some other line element, such as aerial or signal cables, pipes, etc., can be laid. The cross-sectional profile of the profiled rail 14 can also be closed, as is shown in FIG. 8. The upper part 20 of the legs 18 can have an inclination, which forms an angle $\alpha$ of between about 45° and 120° to the longitudinal center plane, preferably between about 45° and 90°, ideally about 53°. The profiled rail 14 can be made of plastic, metal or some composite material, preferably by an extrusion process.

The groove 16 in the longitudinal side edges of each floorboard 12 has a configuration corresponding to the profiled rail 14, namely an upper beveled face 30 (FIG. 1), against which the upper part 20 of the leg 18 of the profiled rail bears in the ready-fitted state in FIG. 3. A recess 32 opening into the groove 16 is configured to receive the flange 22 when the profiled rail 14 is inserted in the groove 16 in the one floorboard 12 and when the other, adjacent floorboard 12 is forced on over the profiled rail 14. In addition, the groove 16 has a lower beveled face 34 for supportively bearing against the outer side of the lower leg part 24 of the profiled rail 14. A slot 36 opening into the groove 16 extends substantially parallel with the top and bottom sides of the board to create a resilient tongue 37 having a springing and holding-together function, which responds to the movements of the material due to changes in temperature and humidity. It is most expedient to form the grooves 16 in the side edges of the floorboards in mirror symmetry, which makes it possible to lay the floorboards 12 with any chosen side one against the other. Naturally, the grooves 16 on the opposite sides of the boards can also have a non-mirror-symmetrical configuration. It should be emphasized that the grooves 16 in question can not only be formed in the long-side edges of the boards, but also in their short-side or end-side edges.

When laying a floor system according to the invention, the profiled rail 14 is first clamped into the groove 16 in the one, preferably in the already laid-down floorboard 12. The profiled rail 14 is here dimensioned such that the outer side of the upper and lower leg parts 20, 24 and that side of the flange 22 which is facing the profiled rail 14 will be resiliently and lockingly pressed against the respective beveled faces 30, 34 of the groove and against that side face 38 of the recess 32 which is facing the joint. After this, the second floorboard 12 is hooked onto the profiled rail 14, as is shown in FIGS. 1 and 2, until the ready-locked state in FIG. 3 has been reached, the opposite leg 18 engaging in the groove 16 in a similar manner to the leg first described, so that a play-free, locked joint is created between the two adjacent floorboards 12.

If so desired, a line element, such as a floor heating cable 28, can subsequently be inserted into the inner cavity 26 in the profiled rail 14 and be laid there concealed within the thickness of the boards. The profiled rail 14 can then distribute the heat generated in the cable 28 to the floorboards 12 in a less concentrated manner than if the cable were laid in a separate groove directly in the timber in the floorboard. The profiled rail 14 can act at the same time as a screening element against magnetic fields, since it is made of metal. Naturally, it is possible to lay other types of lines in concealment in the cavity 26, such as aerial and signal cables, pipes, power-supplying electric lines, and the like (not shown).

Figure 5:
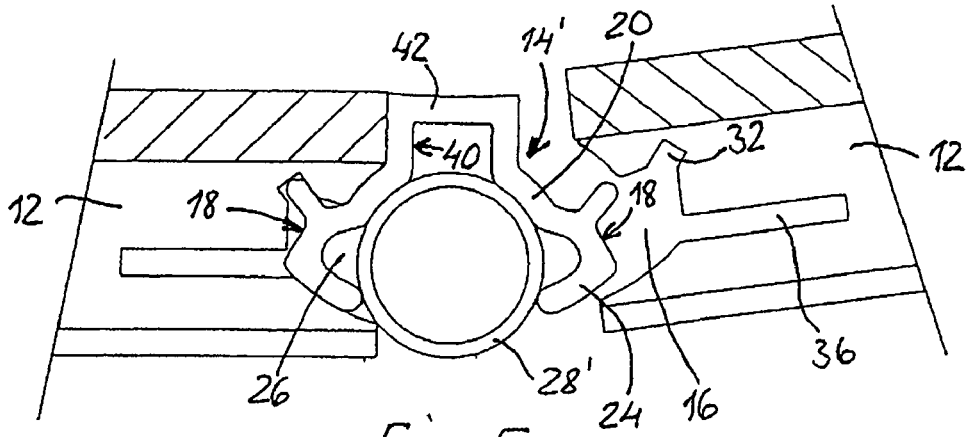
FIG. 5 is a view similar to FIG. 1, but shows an alternative profiled rail having a web section, visible in the finished joint, of a substantially U-shaped central part of the profiled rail for accommodation of a water pipe of larger diameter than the electric cable in FIGS. 1-4.
Figure 6:
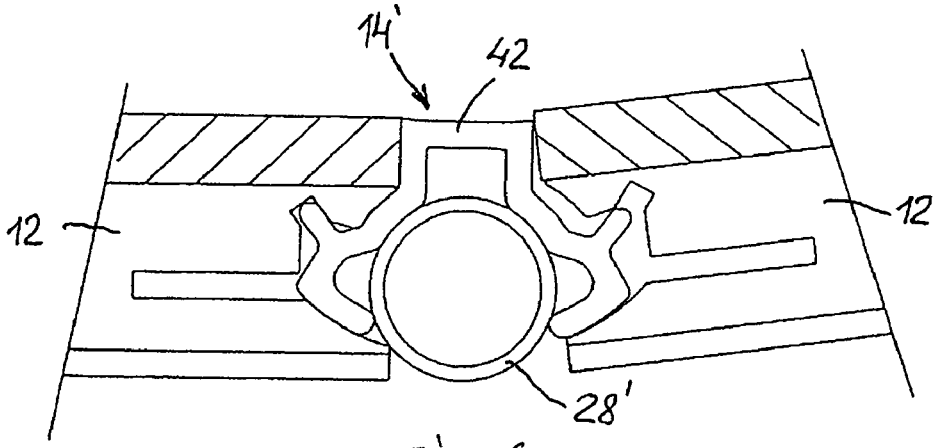
FIG. 6 is a view similar to FIG. 2, during a subsequent joining-together phase.
Figure 7:
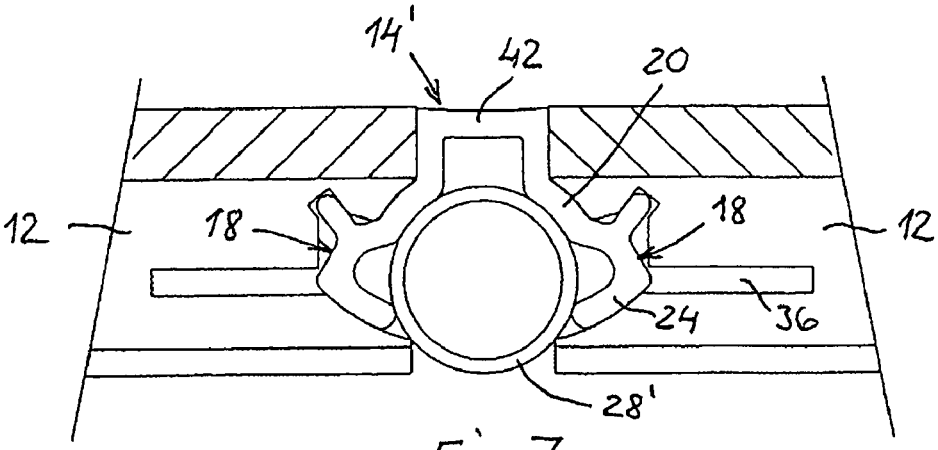
FIG. 7 is a view corresponding to FIG. 3 of the embodiment in FIG. 5.

In FIGS. 5-7, various assembly stages are shown in an embodiment of a floor laying system according to the invention, in which it is possible to lay in a profiled rail 14' a line element of greater diameter than a standard-thickness floor heating cable 28 as in the first embodiment in FIGS. 1-4. Thus, it is also feasible to accommodate a pipe 28' for water-borne floor heating in the cavity 26 in the profiled rail 14' by designing the central section of the rail 14' with an up-and-down facing, substantially U-shaped, upright section 40, which bridges a gap between the adjacent floorboards 12, a web part 42 of this section 40 being able to form a seam-like joint face between these.

In place of a water pipe 28', in the second embodiment it is also conceivable to lay lighting elements, alarm sensors, hearing loops, and the like in the cavity 26, at least the web part 42 being able to be made wholly or partially transparent or be provided with holes for these elements. Otherwise, the design of the legs 18 of the profiled rail 14' and the grooves 16 of the floorboards, like the insertion and locking stages in FIGS. 5-7, is in all respects the same as in the first embodiment in FIGS. 1-4.

In FIG. 8 there is shown an embodiment of a profiled rail 14" having a closed profile, in which the legs 18" meet at the bottom edge. Here too, the configuration of the legs 18" can in all respects substantially correspond to that which has previously been described to achieve a locking coupling of adjacent floorboards 12. Unlike the previously described leg configuration, the leg 18" has a middle, vertical section 44, which bears against a corresponding flat, vertical bevel 46 in the groove 16, so that an additional support is obtained in a direction transversely to the joint. The profiled rail 14" has in this case four supporting faces which bear against corresponding bevels 30, 34, 38, 46, in the groove 16. In addition, the spring-creating slot 36 has been moved upwards to almost border on the recess 32.

Figure 9:
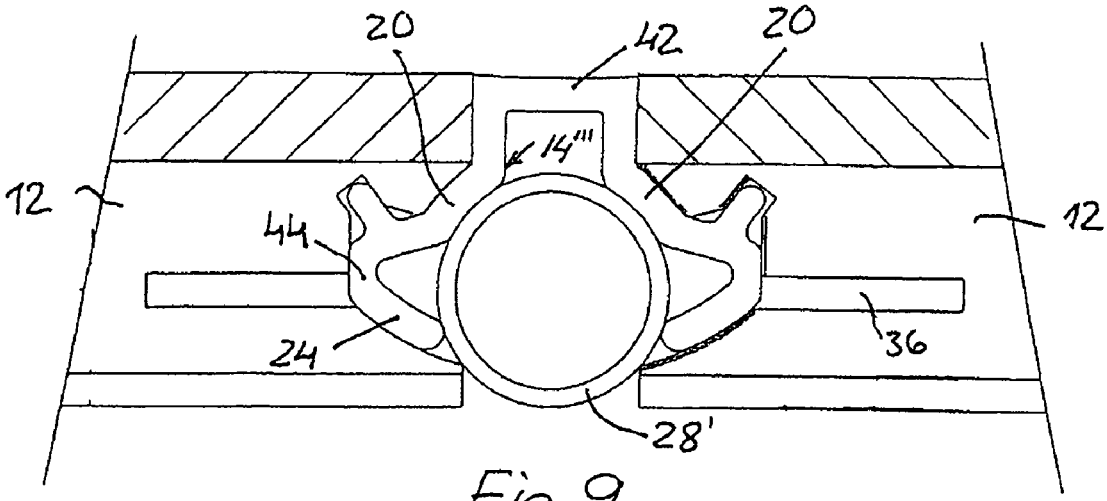
FIG. 9 shows a view similar to FIG. 7 of an embodiment having a somewhat modified profile of the profiled rail and the groove in the side edge of a floorboard.
Figure 10:
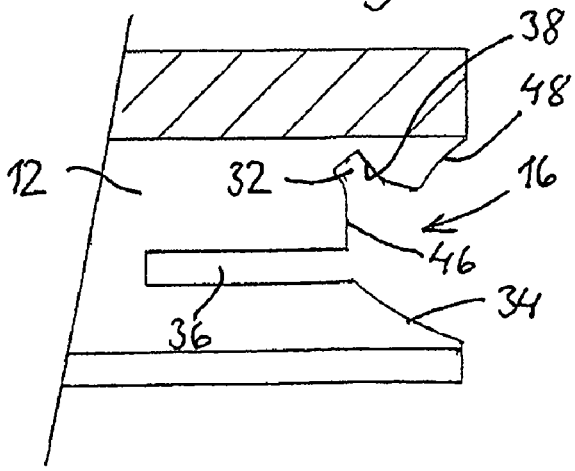
FIG. 10 is a cross-sectional view of just the edge section of a floorboard in the embodiment according to FIG. 9.

In the embodiment according to FIG. 9, which in all respects substantially corresponds to that shown in FIGS. 5-7, the groove 16, as can be seen in FIG. 10, also has a vertical supporting face or bevel 46, against which the vertical part 44 of the profiled rail 14" can bear, and a somewhat concave face 48 for bearing contact against a curved, upper leg part 20 of the profiled rail 14".

What is claimed is:

1. A floor laying system for joining together floorboards along side edges thereof in which grooves are made, comprising:

a separate profiled rail, which is disposed between the side edges of the boards and couples together the boards, the profiled rail having a plurality of legs projecting to opposite sides from a central longitudinal center plane of the profiled rail, wherein each of the legs is designed to lockingly engage in a groove in the respective opposing side edges of the floorboards, wherein each leg of the profiled rail has a first section having a thereto connecting, projecting flange for engagement in a corresponding recess which opens into the groove in the side edge of the respective floorboard, in which the flanges of the profiled rail and the corresponding recesses in the grooves diverge towards that side of the floorboards which forms a top surface layer thereof, and wherein the legs of the profiled rail have a respective second section that converges towards that side of the floorboards which forms a bottom side thereof, wherein the first section of each leg bears against a first beveled face of the groove, whilst the second section of each leg bears against a second beveled face of the groove in the side edge of the respective floorboard, and wherein the first beveled face of the one of two coupled-together floorboards is substantially diametrically opposite the second beveled face of the other of the coupled-together floorboards, in addition to which a slot running substantially parallel with the top and bottom sides of the respective board opens into the groove in each floorboard between the said recesses and the second beveled face, whereby said slot creates a resilient tongue having a springing and holding-together function on the floorboards, which responds to the movements of the material due to changes in temperature and humidity.

2. The system according to claim 1, wherein the grooves in the opposing side edges of two coupled-together floorboards are designed such that the profiled rail lies mounted therein fully concealed from the top side of the floorboards.

3. The system according to claim 2, wherein the legs projecting in opposite directions from the longitudinal center plane of the profiled rail delimit a channel-shaped cavity for the accommodation of at least one line element.

4. Application of a floor laying system according to claim 3 for laying a floor heating line in the profiled rail.

5. The application according to claim 4 for laying an electric heating cable in the profiled rail.

6. The application according to claim 4 for laying a pipe for liquid floor heating in the profiled rail.

7. The system according to claim 3, wherein the cavity is open in the direction of that side of the floorboards which forms the bottom side thereof.

8. The system according to claim 7, wherein the first sections of the legs of the profiled rail are connected by means of an intermediate, substantially U-shaped section having a web part which forms a seam-like joint face, visible from the top side of the floorboards, between two adjacent floorboards.

9. The system according to claim 8, wherein the legs of the profiled rail have a respective third section between the first and second sections, in which a flat outer side of the third section supportively bears against a third, vertical beveled face of the groove in the respective board.

10. The system according to claim 9, wherein the first leg sections of the profiled rail are convexly curved and bear against the respective concave beveled faces of the grooves.

11. The system according to claim 10, wherein the profiled rail and the grooved configuration of the side edges of the floor boards are designed in mirror symmetry relative to a longitudinal center plane through a joint between adjacent floorboards.

12. The system according to claim 11, wherein the first leg sections of the profiled rail have an inclination, which forms an angle ($\alpha$) of between about 40° and 120° to the longitudinal center plane of the profiled rail.

13. The system according to claim 12, wherein the angle of inclination ($\alpha$) measures about 53°.

14. The system according to claim 11, wherein the first leg sections of the profiled rail have an inclination, which forms an angle ($\alpha$) of between about 45° and 90° to the longitudinal center plane of the profiled rail.

* * * * *